United States Patent [19]

Lewecke et al.

[11] Patent Number: 4,693,458

[45] Date of Patent: Sep. 15, 1987

[54] CLAMPING ARRANGEMENT FOR LUMBER ELEMENTS

[75] Inventors: Ernst Lewecke, Lemgo; Manfred Riesenberg, Horn-Bad Meinberg, Fed. Rep. of Germany

[73] Assignee: Lewecke Maschinenbau GmbH, Blomberg, Fed. Rep. of Germany

[21] Appl. No.: 934,194

[22] Filed: Nov. 24, 1986

[30] Foreign Application Priority Data

Oct. 21, 1986 [DE] Fed. Rep. of Germany ..... 3635716

[51] Int. Cl.[4] ..... B25B 11/00

[52] U.S. Cl. ..... 269/21; 269/329

[58] Field of Search ..... 269/21, 329; 144/278 A; 83/451, 360; 51/235; 294/64.1

[56] References Cited

U.S. PATENT DOCUMENTS 3,652,075 3/1972 Thompson ..... 269/21

4,066,249 1/1978 Huber et al. ..... 269/21

FOREIGN PATENT DOCUMENTS 808280 2/1981 U.S.S.R. ..... 144/278 A

*Primary Examiner*—Robert C. Watson

*Attorney, Agent, or Firm*—Erwin S. Teltscher

[57] ABSTRACT

An arrangement for clamping a lumber element during its processing especially in a sawing installation includes at least two spaced abutment members having abutment surfaces for the lumber element. A substantially vertically extending suction plate is situated between the abutment elements and includes an upright contact plane. The suction plate is movable transversely to its contact plane and has a plurality of suction openings capable of exerting suction effect on the lumber element which is juxtaposed with the contact plane. Respective contactless sensors sense the presence of the lumber element at the respective suction openings and generate corresponding indication signals. The suction effect of the suction openings is controlled by an electrical switching and control device in dependence on the indication signals.

16 Claims, 7 Drawing Figures

CLAMPING ARRANGEMENT FOR LUMBER ELEMENTS

BACKGROUND OF THE INVENTION

The present invention relates to the clamping of workpieces in general, and more particularly to an arrangement for clamping (maintaining firmly in position) lumber elements, such as tree trunks, lumber beams or the like, during the processing thereof, especially those which are integrated into a sawing installation.

Currently, relatively large tree trunks, lumber beams or the like which are to be subdivided in a sawing installation into boards, planks, small beams or the like are held in position by clamping wedges which act on the lumber element from above and from below.

This conventional approach brings about the disadvantage that the clamping wedges penetrate, dig into or otherwise deform the lumber element to be processed and thus damage the surface region of the lumber element. Inasmuch as the tree trunk being processed is turned after each sawing or cutting operation about its longitudinal axes by a quarter of its circumference, the above-mentioned penetration of the clamping wedges into the lumber element, and thus the attendant damaging of the boards or the like cut from the lumber element, occurs time and time again during each clamping operation following such turning.

A further disadvantage of the use of the clamping wedges resides in the relatively low utilization of or yield from the cross section of the lumber element, inasmuch as the cross section of the lumber element can be sawed only to an extent permitted by the clamping wedges, that is until the path of movement of the saw relative to the lumber element during the sawing operation reaches the clamping wedges. After that, what remains of the original lumber element is basically waste or refuse wood. Yet, especially nowadays, with the relatively high lumber prices, it is desired to utilize the valuable lumber material to the utmost possible extent.

SUMMARY OF THE INVENTION

Accordingly, it is a general object of the present invention to avoid the disadvantages of the prior art.

More particularly, it is an object of the present invention to provide a clamping arrangement for lumber elements which does not possess the drawbacks of the known arrangements of this type.

Still another object of the present invention is to devise an arrangement of the type here under consideration which would render it possible to clamp the lumber elements in such a manner as not to damage the surface areas thereof.

It is yet another object of the present invention to design the above arrangement in such a manner as to render it possible to utilize the entire cross section of the lumber element, without leaving any useless remainder.

A concomitant object of the present invention is so to construct the arrangement of the above type as to be relatively simple in construction, inexpensive to manufacture, easy to use, capable of automation, and yet reliable in operation.

In keeping with these objects and others which will become apparent hereafter, one feature of the present invention resides in an arrangement for clamping a lumber element during its processing, especially in a sawing installation, this arrangement comprising at least two spaced abutment members having abutment surfaces for the lumber element and a substantially vertically extending suction plate situated between the abutment elements and including an upright contact plane. The suction plate is movable transversely to the contact plane thereof and has a plurality of suction openings capable of exerting suction effects on the lumber element which is juxtaposed with the contact plane. This arrangement further includes sensing means including a plurality of contactless sensors for sensing the presence of the lumber element at the respective suction openings and for generating corresponding indication signals, and means for controlling the suction effect of the suction openings in dependence on the indication signals.

Advantageously, the suction openings of the suction plate are arranged at the contact plane in a plurality of substantially horizontally extending, vertically spaced parallel rows each including at least two of the suction openings, and one of the sensors is then associated with each of the rows. The sensors may be constituted by light barriers, by photoelectric cells, or by laser light eyes. It is further advantageous when the suction plate has a rectangular basic configuration, with the longer dimension of the rectangular basic configuration extending in the horizontal direction and in the longitudinal direction of the lumber element, when the suction openings of the rows are arranged in respective vertically extending columns above one another at predetermined distances from each other, and wherein the two suction openings of each of the rows are spaced from each other in the longitudinal direction by a distance which is a multiple of the predetermined distance.

According to a further advantageous aspect of the present invention, the sensors are arranged on the suction plate in a vertically extending column which is laterally adjacent to one of the columns of the suction openings. In this context, it is advantageous when that one of the sensors which is associated with a lowermost one of the rows of suction openings is situated at the elevation of the lowermost row, while those of the sensors which are associated with the respective higher ones of the rows of the suction elements are upwardly offset by one row relative to the associated one of the rows. The suction plate is advantageously provided at the contact plane thereof with a circumferential seal arranged at a marginal region of the suction plate, and with a plurality of additional seals each extending between two vertically adjacent ones of the rows of the suction openings.

It is particularly advantageous when the controlling means includes a plurality of valves which control the supply of underpressure to the suction openings, an electrical switching and control device operative for generating control signals for controlling the opening and closing of the valves, and conduit means for connecting the sensors with the electrical switching and control device for supplying the indication signals thereto, and for supplying the control signals to the valves.

It is also advantageous when there are further provided means for mounting the suction plate, such mounting means including a carrier frame movable on respective guides in a horizontal direction transversely to the contact plane, and a centrally disposed pivoted suspension which mounts the suction plate on the carrier frame. Then, there may be further provided a vacuum accumulator and a vacuum distributor which are mounted on the carrier frame, a vacuum pump, and an air conduit connecting the vacuum pump with the vacuum accumulator. The arrangement may further advantageously comprise two additional air conduits connecting the vacuum accumulator with the vacuum distributor, and two valves each interposed in one of the additional air conduits. The additional air conduits may advantageously open into the vacuum distributor laterally at respective oppositely situated sides of the vacuum distributor.

When, as mentioned before, the suction openings are arranged in respective horizontally extending rows which are arranged at vertical spacings from one another, there is advantageously further provided a plurality of distributing air conduits each connecting the vacuum distributor with one of the suction openings and a plurality of valves each interposed in one of the distributing air conduits except for those which lead to the suction openings of the lowermost one of the rows.

According to another advantageous facet of the present invention, there is further provided an additional plate arranged at a rear side of the suction plate and including a plurality of heating elements.

It may be seen from the above that the clamping arrangement according to the present invention operates with an upright vacuum suction plate which pulls the lumber element to be processed especially sawed, firmly against two abutments and thus assures, on the one hand, a clamping action which is protective of the surface region of the lumber element, that is, it does not inflict any damage to such surface region and, on the other hand, renders it possible to saw the entire cross section of the lumber material into useful products, without leaving any unutilizable waste pieces. The suction plate is subdivided into individual suction zones which are controlled by respective sensors which cooperate with the lumber element to be processed and which exactly detect or register the cross section of the lumber element as it grows smaller and smaller as the sawing operation progresses and correspondingly switch the respective suction zones on and off.

Furthermore, the suction plate is movable with respect to the abutments, in order to avoid damage to the suction side of the suction plate, so that the suction plate is moved toward the lumber element and attracts the same by suction only after the lumber element has already been brought into abutment with the aforementioned abutments. Inasmuch as the lumber element is constantly or frequently turned about its longitudinal axis during the subdivision of its cross section, the sensors sense or detect the size of the cross section after each turning and the corresponding suction zones are then controlled.

The vacuum suction plate of the present invention has a simple construction and operates with a high degree of reliability. Moreover, it is also possible to easily incorporate or integrate the clamping arrangement of the present invention into a sawing installation.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
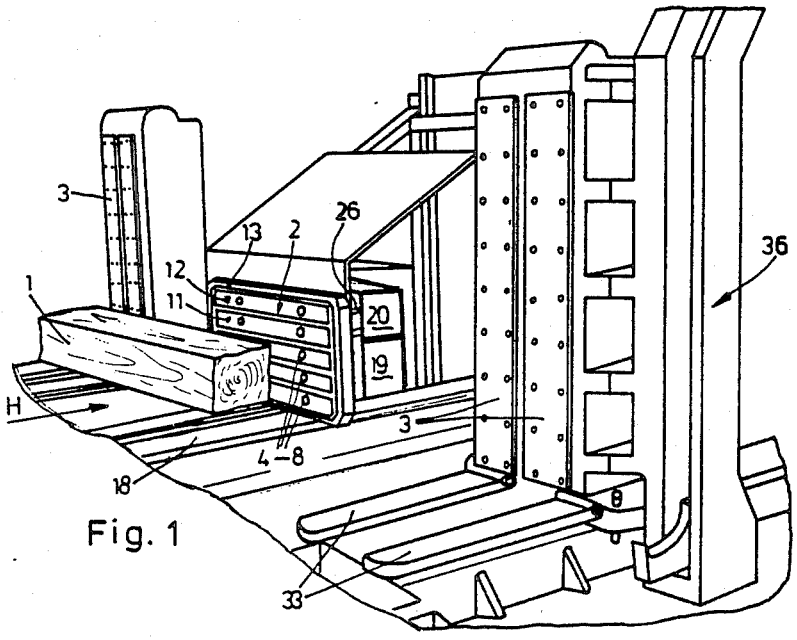
FIG. 1 is a perspective view of a clamping arrangement according to the present invention for clamping lumber elements, wherein the arrangement is shown to include an upright vacuum suction plate positioned between two abutment members for the lumber element and to be integrated into a sawing installation.

Referring now to the drawing in detail, and first to FIG. 1 thereof, it may be seen that the reference numeral 1 has been used therein to identify a lumber element, such as a tree trunk, a wooden beam or the like, which is to be clamped (firmly held in position) during its processing, especially during sawing, by a clamping arrangement according to the present invention. The clamping arrangement includes an upright vacuum suction plate 2 which is movable with respect to contact surface (abutments) 3 for the lumber element 1 transversely to its vertical upright plane and is provided with a plurality of suction openings 4 to 8. The suction openings 4 to 8 are controlled as to their suction effect, that is, switched on and off so that they either exercise or do not exercise the suction effect, by means of respective sensors 9 to 13 which sense the lumber element 1 in a contactless manner.

It is currently preferred for the suction plate 2 to have a rectangular basic configuration and to be so oriented that the longer side of its rectangular configuration (longitudinal direction) extends in the longitudinal direction of the lumber material 1, that is, in the horizontal direction.

Figure 4:
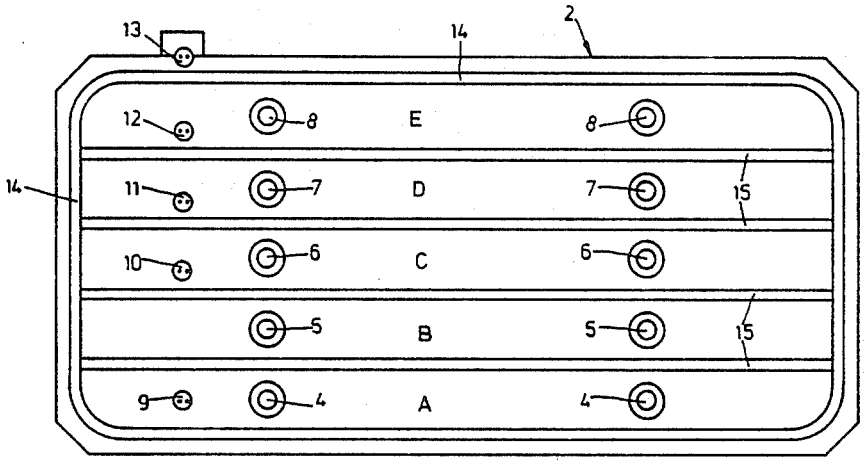
FIG. 4 is a front elevational view of the suction plate of the clamping arrangement of FIG. 1 depicting respective suction openings and sensors associated therewith.

As may be seen particularly in FIG. 4 of the drawing, the suction openings 4 to 8 of the suction plate 2 are arranged in several parallel rows (suction zones) A to E which are situated one above the other. Each of the rows A to E includes at least two of the suction openings 4 to 8, the two openings 4 to 8 provided in each of the rows A to E being disposed at a relatively large distance from one another, while the suction openings 4 to 8 which are arranged above one another in the respective rows A to E and which are disposed in respective vertical columns or rows are spaced by a relatively small distance from each other. The two suction openings 4 to 8 arranged in the respective one of the rows A to E extending in the longitudinal direction of the suction plate 2 are spaced from each other by a distance which is a multiple of the distance separating the vertically adjacent ones of the suction openings 4 to 8 from each other.

A different one of the sensors 9 to 13, which may be constituted by light barrier devices, photoelectric cells, laser-light eyes or the like, is associated with each of the suction opening rows A to E. As also shown in FIG. 4 of the drawing, the sensors 9 to 13 are also arranged vertically above one another and laterally of one of the vertically extending suction opening columns or rows.

At the suction side, the suction plate 2 is provided at its marginal portion with a circumferential seal 14. Furthermore, an additional seal 15, which also extends in the longitudinal direction of the suction plate 2, is arranged between each two of the horizontally extending suction opening rows A to E, so that each of the suction zones A to E is separated from (closed with respect to) the other suction zones A to E.

The suction plate 2 is supported by means of a central articulated suspension 16 on a carrier frame 17. The carrier frame 17, and thus in the final analysis also the suction plate 2, is movable in a manner of a carriage or slide on horizontal guides 18 in opposite directions transversely of the vertical upright plane of the suction plate 2, and thus also transversely with respect to the longitudinal direction of the lumber element 1 (steplessly or infinitely shiftable in the directions indicated by arrows F and G in FIG. 2 of the drawing).

The suction plate 2 is situated in its upright position between two upright abutments 3 which constitute the bearing surfaces for the lumber element 1 to be processed and which are parts of a sawing device 36, into which the clamping arrangement of the present invention is integrated.

A vacuum accumulator 19 and a vacuum distributor 20, which are constituted by closed containers, chambers, housings or the like, are arranged on or at the carrier frame 17. As shown particularly in FIG. 5 of the drawing, the vacuum accumulator 19 is in communication, via two air conduits 21 each of which has a valve 22 incorporated therein, with the vacuum distributor 20. In the illustrated construction, the two air conduits 21 open laterally into the vacuum distributor 20 from two mutually oppositely situated sides of the vacuum distributor 20. An underpressure is created in the vacuum accumulator 19 through an air conduit 23 by a vacuum pump 25, the air conduit 23 having a venting valve incorporated therein.

Figure 2:
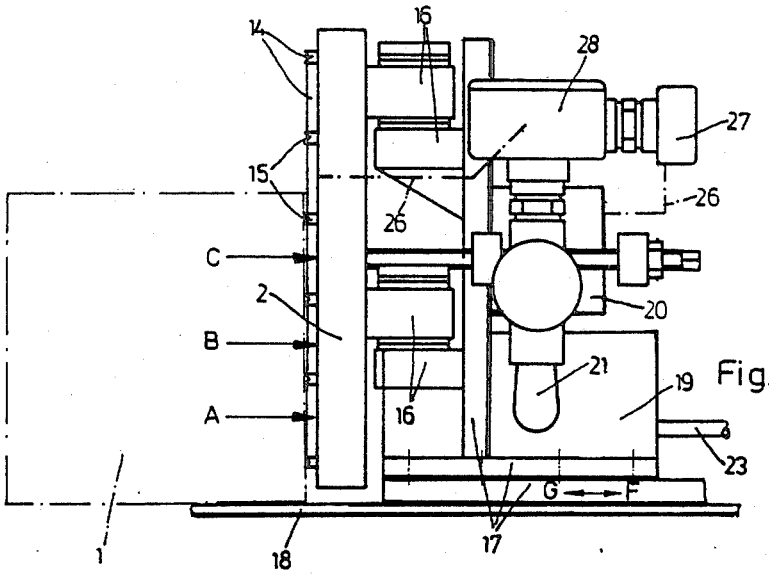
FIG. 2 is a side elevational view of the clamping arrangement of FIG. 1, showing a vacuum accumulator, vacuum distributor, air filter and suction plate suspension.
Figure 5:
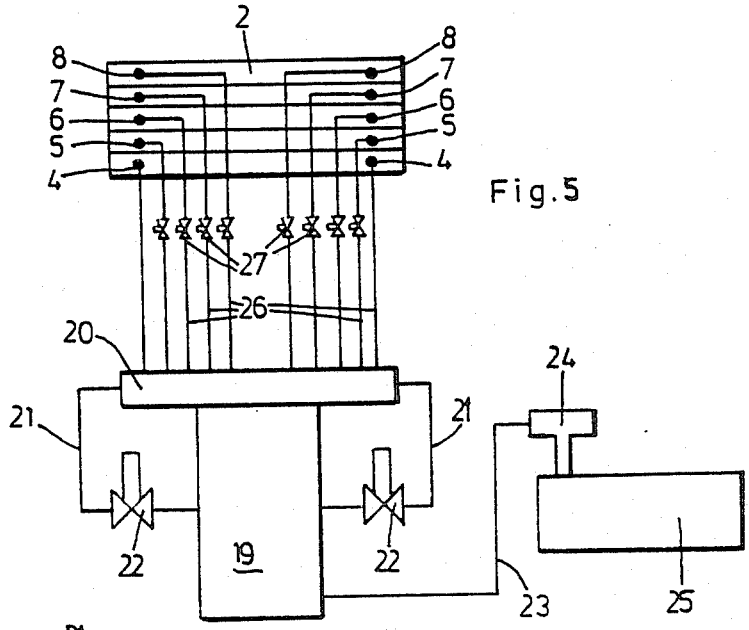
FIG. 5 is a somewhat diagrammatic view illustrating the components of the clamping arrangement of FIG. 1 and interconnections between such components.
Figure 6:
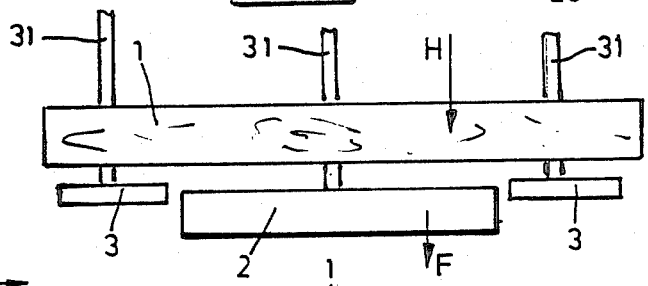
FIG. 6 is a diagrammatic simplified top plan view of the abutments and the suction plate of the arrangement of FIG. 1, with the suction plate being in its retracted position while the lumber element is being delivered to the abutments.

An air conduit 26 extends from the vacuum distributor 20 to each of the suction openings 4 to 8. As shown in FIG. 5, those of the air conduits 26 which lead to the suction openings 5 to 8 have respective valves 27 incorporated therein, while the two air conduits 26 which lead to the two lowermost suction openings 4 do not have any valves 27 included therein. FIGS. 2 and 6 indicate that the air conduits 26 have respective air filters 28 incorporated therein.

Figure 3:
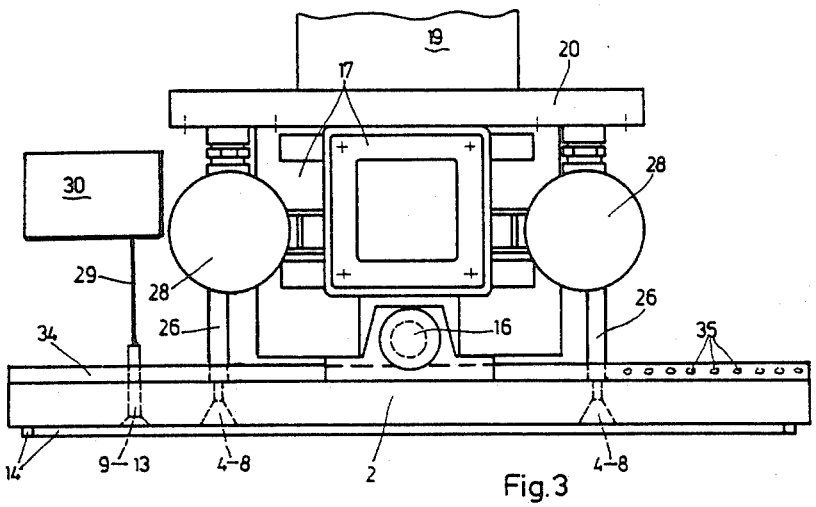
FIG. 3 is a top plan view of the clamping arrangement of FIG. 2.

As indicated in FIG. 3 of the drawing, the sensors 9 to 13 are connected by electrical conduits 29 with an electrical and electronic switching and control arrangement 30. The switching and control arrangement 30 is operative for controlling the valves 27 and 22 and, as the case may be, even the vacuum pump 25.

Having so described the construction of the arrangement of the present invention, the operation of this arrangement for clamping the lumber element 1 by means of the suction plate 2 and the abutments 3 will now be explained in some detail, still with reference to the drawing.

The lumber element 1, such as a tree trunk or a beam, is delivered to the abutments 3 transversely to its longitudinal direction, as indicated by an arrow H in FIG. 6, on guides 31 by suitable delivery equipment, such as chains provided with entraining members, shovels or the like. At this time, the suction plate 2 is retracted with respect to the abutments 3 in the direction of the arrow F, so that the lumber element 1 which reaches the abutments 3 with a relatively high amount of kinetic energy and which thus exerts a relatively high amount of pressing force on the abutments 3 cannot damage the suction plate 2.

Figure 7:
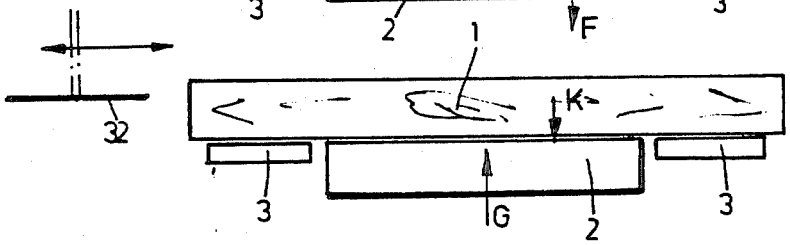
FIG. 7 is a view similar to FIG. 6 but with the suction plate in its extended or operative position in which it clamps the lumber element against the abutments.

After the lumber element 1 has reached its position in which it is in contact with the abutments 3, the suction plate 2 is displaced, as indicated in FIG. 7 of the drawing, in the direction of the arrow G toward the lumber element 1 and attracts the lumber element 1 in the direction of an arrow K by exerting a suction effect thereon, thereby pressing the lumber element 1 firmly against the abutments 3, so that the lumber element 1 is drawn to the suction plate 2 by the vacuum applied thereto by the suction plate 2 and is held firmly in a clamped condition thereof on the abutments 3 by the action of the suction plate 2.

At this time, the processing of the lumber element 1 by a saw 32, which is also indicated in FIG. 7 of the drawing and which moves, for instance, in and opposite to the longitudinal direction of the lumber element 1, can proceed and the lumber element 1 is thus subdivided into smaller boards, planks, beams or the like.

As soon as the lumber element 1 comes into abutment with the suction plate 2, those of the sensors 9 to 13 which are covered by the lumber element 1 detect the presence of the lumber element 1 thereat and then control the suction openings 4 to 8 in such a manner that, by opening the respective valves 27, an underpressure is applied by the vacuum distributor 30, that is air pressure is aspirated into the suction openings 4 to 8, and consequently, the vacuum zones A to E have a vacuum created therein. FIG. 7 shows that the lumber element 1 is held firmly in position by the thus applied vacuum until the sawing operation has been completed. Then, the switching and control arrangement 30 closes the valves 27 which control the creation of a vacuum to the suction openings 5 to 8, so that the application of underpressure to these suction openings 5 to 8 is discontinued.

As mentioned before, no valves 27 are interposed into the air conduits 26 leading to the two lowermost suction openings 4, so that these suction openings 4 constantly draw air in, so long as the lumber element 1 is present at the region of its sensor 9, regardless of whether this lumber element 1 is situated directly at the suction plate 2 or at a distance therefrom.

The lumber element 1 is turned several times during the sawing thereof into boards, planks or beams about its longitudinal axis. This is accomplished by means of pivotable lifting fork elements 33 of the sawing device 36.

As a result of the turning and subsequent cutting of the lumber element 1, the latter becomes smaller and smaller after each cutting operation, so that not all but only some of the suction openings 4 to 8 remain effective, namely in each instance those for which the associated sensors 10 to 13 still detect the presence of the lumber element 1.

The suction openings 8 are controlled, that is switched on and off, by the sensor 13, the suction openings 7 by the sensor 12, the suction openings 6 by the sensor 11, and the suction openings 5 by the sensor 10. Inasmuch as the height of the lumber element 1 gradually decreases as the cross section of the lumber element 1 is being reduced, since the lumber element 1 is always supported on the guides 31 which thus serve as a reference surface or plane, the suction openings 8 to 5 are being switched off from above to below. On the other hand, the two lowermost suction openings 4 draw air in constantly and are switched off only when the lumber element 1 is not present at the suction plate 2 any longer. Thus, it may be seen that the switching on and switching off of the suction openings 4 to 8 is dependent on the size of the cross-sectional area, and thus on the effective height, of the lumber element 1, and that the effective height of the lumber element 1 is detected or registered by the sensors 9 to 13 and the operation of the suction openings 4 to 8 is controlled accordingly.

As indicated in FIG. 3 of the drawing, the suction plate 2 may be so constructed as to be heatable, in that an auxiliary plate 34 having heating elements 35 is mounted on the back of the suction plate 2 and transfers the heat produced by the heating elements 35 to the suction plate 2. This is particularly advantageous when the sawing installation is operated during a cold time of the year, particularly in an unheated environment, since then the freezing up of the suction openings 4 to 8 is prevented even if the lumber elements 1 being supplied to the sawing installation have moisture, snow or ice layers or patches thereon.

As a result of the provision of the pivotable suspension 16 for the suction plate 2, the suction plate 2 can become fitted in an advantageous manner to the longitudinal form of the lumber element 1, as a result of which there is always obtained a secure contact between the suction plate 2 and the lumber element 1.

It is also within the framework of the present invention and contemplated to also utilize this clamping arrangement with the vertically extending suction plate 2 for the clamping and firm holding of other workpieces in other branches of industry.

The suction openings 4 to 8 are configured, as indicated in FIG. 3 of the drawing, as sink holes and the sensors 9 to 13 are supported in the suction plate 2. The air conduits 21, 23 and 26 are preferably constituted by flexible hoses; however, metallic air conduits may be used as well, at least partially. The vacuum pump may be also mounted on the carrier frame 17 or arranged in the sawing installation at a distance from the carrier frame 17.

The lumber element 1 is indicated in FIG. 2 of the drawing in dash-dotted lines. This particular lumber element 1 has such dimensions that it is attracted to the suction plate 2, and thus clamped, by the vacuum or suction effect exerted thereon by the suction rows A, B and C. On the other hand, the two suction rows D and E which are situated above the suction rows A, B and C are ineffective, as the sensors associated therewith are not covered by the lumber element 1.

While the present invention has been described and illustrated herein as embodied in a specific construction of a clamping arrangement for a sawing installation, it is not limited to the details of this particular construction, since various modifications and structural changes are possible and contemplated by the present invention. Thus, the scope of the present invention will be determined exclusively by the appended claims.

What is claimed is:

1. An arrangement for clamping a lumber element during its processing, especially in a sawing installation, comprising at least two spaced abutment members having abutment surfaces for the lumber element;

a substantially vertically extending suction plate situated between said abutment elements and including an upright contact plane, said suction plate being movable transversely to said contact plane, and having a plurality of suction openings capable of exerting suction effects on the lumber element which is juxtaposed with the contact plane;

sensing means including a plurality of contactless sensors for sensing the presence of the lumber element at the respective suction openings and for generating corresponding indication signals; and means for controlling the suction effect of said suction openings in dependence on said indication signals.

2. The arrangement as defined in claim 1, wherein said suction openings of said suction plate are arranged at said contact plane in a plurality of substantially horizontally extending, vertically spaced parallel rows each including at least two of said suction openings, and wherein one of said sensors is associated with each of said rows.

3. The arrangement as defined in claim 2, wherein said sensors are constituted by light barriers.

4. The arrangement as defined in claim 2, wherein said sensors are constituted by photoelectric cells.

5. The arrangement as defined in claim 2, wherein said sensors are constituted by laser light eyes.

6. The arrangement as defined in claim 2, wherein said suction plate has a rectangular basic configuration, with the longer dimension of the rectangular basic configuration extending in the horizontal direction and in the longitudinal direction of the lumber element; wherein said suction openings of said rows are arranged in respective vertically extending columns above one another at predetermined distances from each other; and wherein said two suction openings of each of said rows are spaced from each other in said longitudinal direction by a distance which is a multiple of said predetermined distance.

7. The arrangement as defined in claim 6, wherein said sensors are arranged on said suction plate in a vertically extending column which is laterally adjacent to one of said columns of said suction openings.

8. The arrangement as defined in claim 7, wherein that one of said sensors which is associated with a lowermost one of said rows of suction openings is situated at the elevation of said lowermost row, while those of said sensors which are associated with the respective higher ones of said rows of said suction elements are upwardly offset by one row relative to the associated one of said rows.

9. The arrangement as defined in claim 2, wherein said suction plate is provided at said contact plane thereof with a circumferential seal arranged at a marginal region of the suction plate, and with a plurality of additional seals each extending between two vertically adjacent ones of said rows of said suction openings.

10. The arrangement as defined in claim 1, wherein said controlling means includes a plurality of valves which control the supply of underpressure to said suction openings, an electrical switching and control device operative for generating control signal for controlling the opening and closing of said valves, and conduit means for connecting said sensors with said electrical switching and control device for supplying said indication signals thereto, and for supplying said control signals to said valves.

11. The arrangement as defined in claim 1, and further comprising means for mounting said suction plate, including a carrier frame movable on respective guides in a horizontal direction transversely of said contact plane, and a centrally disposed pivoted suspension which mounts said suction plate on said carrier frame.

12. The arrangement as defined in claim 11, and further comprising a vacuum accumulator and a vacuum distributor mounted on said carrier frame, a vacuum pump, and an air conduit connecting said vacuum pump with said vacuum accumulator.

13. The arrangement as defined in claim 12, and further comprising two additional air conduits connecting said vacuum accumulator with said vacuum distributor, and two valves each interposed in one of said additional air conduits.

14. The arrangement as defined in claim 13, wherein said vacuum distributor has two oppositely situated sides; and wherein said additional air conduits open into said vacuum distributor laterally at said oppositely situated sides thereof.

15. The arrangement as defined in claim 14, wherein said suction openings are arranged in respective horizontally extending rows which are arranged at vertical spacings from one another; and further comprising a plurality of distributing air conduits each connecting said vacuum distributor with one of said suction openings; and a plurality of valves each interposed in one of said distributing air conduits except for those which lead to the suction openings of the lowermost one of said rows.

16. The arrangement as defined in claim 1, and further comprising an additional plate arranged at a rear side of said suction plate and including a plurality of heating elements.

* * * * *